US005464376A

United States Patent [19]

Weston et al.

[11] Patent Number: 5,464,376

[45] Date of Patent: Nov. 7, 1995

[54] MOTORIZED JUMP ROPE APPARATUS

[76] Inventors: Estella D. Weston; Gwennette Y. Cummings, both of 200 W. 143rd St., Apt 17H, New York, N.Y. 10030

[21] Appl. No.: 214,097

[22] Filed: Mar. 17, 1994

[51] Int. Cl.[6] ..... A63B 5/22

[52] U.S. Cl. ..... 482/81; 482/148

[58] Field of Search ..... 482/81, 148; 248/156

[56] References Cited

U.S. PATENT DOCUMENTS

| | | | |
|---|---|---|---|
| 3,481,600 | 12/1969 | Lang, Sr. et al. . | |
| 3,610,616 | 10/1971 | Evans . | |
| 3,770,268 | 11/1973 | Castello | 482/81 |
| 4,082,266 | 4/1978 | Elking . | |
| 4,739,985 | 4/1988 | Rudell et al. . | |
| 4,819,904 | 4/1989 | Shpigel et al. | 248/156 |
| 4,832,304 | 5/1989 | Morgolis | 248/156 |
| 5,113,627 | 5/1992 | Jarrett, Sr. | 248/156 |
| 5,121,917 | 6/1992 | Gray . | |

*Primary Examiner*—Richard J. Apley
*Assistant Examiner*—Lynne A. Reichard

[57] ABSTRACT

A new and improved motorized jump rope apparatus includes a first support assembly which includes a first end portion adapted to be supported by a ground surface. A battery-powered motor assembly is connected to the first support assembly, and a first jump rope assembly is connected to the battery-powered motor assembly at its rotational axis. The first end portion of the first support assembly may include a threaded portion adapted to screw into a ground surface. The first jump rope assembly includes a first mid-portion connected to the battery-powered motor assembly at the rotational axis of the battery-powered motor assembly. Two free end portions of the first jump rope assembly may be displaced a predetermined distance from the rotational axis. In this respect, the first jump rope assembly is C-shaped. The first jump rope assembly may include a second mid-portion located along the rotational axis. In this configuration, the first jump rope assembly may be rectangle shaped or circle shaped. A second support assembly is similar in structure to the first support assembly and also includes a threaded portion adapted to screw into a ground surface. The second support assembly may further include an output drive assembly which is connected to the jump-rope-receiving portion. A second jump rope assembly and a third support assembly added to the second support assembly and the first jump rope assembly permit two jumpers to jump simultaneously.

14 Claims, 4 Drawing Sheets

30
22
30
58
18

33
24
30
32
28
32
30
35
26
16
37
18
10
12
22
14
58
20

MOTORIZED JUMP ROPE APPARATUS

BACKGROUND OF THE INVENTION

1. Field of the Invention

The present invention relates generally to jump ropes and, more particularly, to jump ropes that are mechanically powered.

2. Description of the Prior Art

Jumping rope is healthy and popular recreational and exercise activity that has evolved into a competitive sport. In its simplest form, a jump rope is a flaccid rope, and two ends of the rope are held in a user's hands. To exercise with this type of jump rope, the user must coordinate jumping with hand turning activity. Over the years, jump ropes have been mechanized. The mechanization avoids the need for a user to hold the rope in one's hands. Thus, with a mechanized jump rope, the user need not coordinate jumping with hand turning the rope.

Throughout the years, a number of innovations have been developed relating to mechanized jump ropes, and the following U.S. patents are representative of some of those innovations: U.S. Pat. Nos. 3,481,600; 3,610,616; 4,082,266; 4,739,985; and 5,121,917.

More specifically, U.S. Pat. No. 3,481,600 discloses a jump rope that is powered by a water stream from a water hose. This mechanized jump rope device has a number of disadvantages. A person may not always be near a source of water pressure, and a water hose may be bulky and inconvenient to use. In this respect, it would be desirable if a mechanized jump rope device were provided which does not employ a water source for power and does not require the use of a water hose. Another disadvantage with this device is the constant flow of water needed to power the device. This flow of water is wasteful of water and create a wet or muddy ground surface. In this respect, it would be desirable if a mechanized jump rope device were provided which is not wasteful of water and does not create a wet or muddy ground surface. With this device, the stands that support the jump rope appear to be driven into the ground.

U.S. Pat. No. 3,610,616 discloses a mechanized jump rope device which has a U-shaped frame. A disadvantage of the U-shaped frame is that it limits the size of a rope that can be used. If the rope is too long, the rope will bump into the U-shaped frame. In this respect, it would be desirable if a mechanized jump rope device were provided which does not employ a U-shaped frame.

U.S. Pat. No. 4,082,266 discloses a mechanized jump rope that employs a horizontal bar that extend mid-way across the region encompassed by the turning of the mechanized jump rope. This horizontal bar may be useful for stabilizing a person who is seated and who just lifts one's legs when the jump rope passes by. However, for a person who jumps with one's whole body, the horizontal bar may get in the way and may even cause injuries. In this respect, it would be desirable if a mechanized jump rope device were provided which does not include a horizontal bar that extends mid-way across the region encompassed by the turning of the mechanized jump rope.

U.S. Pat. No. 4,739,985 discloses a mechanized jump rope apparatus that employs a powered crank at one end of a rope. The other end of the rope is attached to a stationary structure such as a fence post or a side of a building. A disadvantage of this device is the requirement of the stationary structure such as a fence post or side of a building.

Often a person may wish to jump rope in an open field or beach area where stationary structures such as fence posts or sides of buildings are not present. In this respect, it would be desirable if a mechanized jump rope device were provided which does not require the presence of stationary structures such as fence posts or sides of buildings.

U.S. Pat. No. 5,121,917 discloses a jumping machine that employs a semi-rigid U-shaped jumping loop that is powered by the hands of a handicapped user. Although this device permits accurate manual control of the positioning of the jumping loop, manual control is a key feature of the device. As mentioned above, one key purpose of providing a mechanized jump rope is to dispense with the requirement of manual operation of the rope.

Still other features would be desirable in a mechanized jump rope apparatus. It may be desirable to set up a mechanized jump rope device at a beach which has a sandy surface. In this respect, it would be desirable if the supports for the mechanized jump rope device would be especially adapted to penetrate and be supported by a sandy surface.

In the sport of jumping rope, there are situations where two people jump at once, such as Double Dutch. In this respect, it would be desirable if a mechanized jump rope device were adapted to be used with a second person.

The jump ropes disclosed in the patents cited above are all supported on two sides of the rope. That is, the two ends of the rope lie along a longitudinal rotational axis. To give a more open access to a mechanized jump rope, it would be desirable if one end of the jump rope were displaced from the longitudinal rotational axis.

Except for U.S. Pat. No. 3,481,600 discussed above which is powered by water from a water hose, the patents cited above disclose mechanized jump ropes that derive electrical power from an AC supply. An AC power source is very inconvenient for outdoor use, especially at a beach which would most likely be far from a source of AC power. In this respect, it would be desirable if a mechanized jump rope device were provided which were powered by portable batteries.

Thus, while the foregoing body of prior art indicates it to be well known to use mechanized jump ropes, the prior art described above does not teach or suggest a motorized jump rope apparatus which has the following combination of desirable features: (1) avoids the need for a user to hold a rope in one's hands; (2) does not require a user to coordinate jumping with hand turning the rope; (3) does not employ a water source for power and does not require the use of a water hose; (4) is not wasteful of water and does not create a wet or muddy ground surface; (5) does not employ a U-shaped frame which limits the size of the rope that can be used; (6) does not include a horizontal bar that extends mid-way across the region encompassed by the turning of the mechanized jump rope; (7) does not require the presence of stationary structures such as fence posts or sides of buildings for supporting the jump rope; (8) is especially adapted to penetrate and be supported by a sandy surface; (9) is adapted to be used with a second jumping person; (10) has one end of the jump rope displaced from the longitudinal rotational axis; and (11) are powered by portable batteries. The foregoing desired characteristics are provided by the unique motorized jump rope apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved motorized jump rope apparatus which includes a first support assembly which includes a first end portion and a motor-retention portion. The first end portion is adapted to be supported by a ground surface. A battery-powered motor assembly is connected to the motor-retention portion of the first support assembly, and a first jump rope assembly is connected to the battery-powered motor assembly at a rotational axis of the battery-powered motor assembly.

The first end portion of the first support assembly may include a threaded portion adapted to screw into a ground surface. A lateral support assembly is connected to the first end portion of the first support assembly proximal to the threaded portion for providing lateral support to the first support assembly when the threaded portion is screwed into a ground surface.

The first jump rope assembly includes a first mid-portion connected to the battery-powered motor assembly at the rotational axis of the battery-powered motor assembly. Two free end portions of the first jump rope assembly may be displaced a predetermined distance from the rotational axis. In this respect, the first jump rope assembly is C-shaped.

The first jump rope assembly may include a second mid-portion located along the rotational axis. In this configuration, the first jump rope assembly may be rectangle shaped or circle shaped.

A second support assembly includes a first end portion and a jump-rope-receiving portion which is adapted to receive the second mid-portion of the first jump rope assembly. The first end portion of the second support assembly may include a threaded portion adapted to screw into a ground surface.

The second support assembly may further include an output drive assembly which is connected to the jump-rope-receiving portion. A second jump rope assembly includes a first mid-portion and a second mid-portion located along the rotational axis. The first mid-portion of the second jump rope assembly is adapted to connect to the output drive assembly of the second support assembly. A third support assembly includes a mid-portion located along the rotational axis. The mid-portion of the third support assembly is adapted to connect to the second mid-portion of the second jump rope assembly, such that both the first jump rope assembly and the second jump rope assembly are driven by the battery-powered motor assembly.

The first end portion of the first support assembly may include a four-footed assembly adapted to be supported by a ground surface. The four-footed assembly includes four feet positioned with respect to each other at right angles.

The first support assembly may be X-shaped and may include two feet adapted to be supported by a ground surface.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least five preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved motorized jump rope apparatus which has all of the advantages of the prior art and none of the disadvantages.

It is another object of the present invention to provide a new and improved motorized jump rope apparatus which may be easily and efficiently manufactured and marketed.

It is a further object of the present invention to provide a new and improved motorized jump rope apparatus which is of durable and reliable construction.

An even further object of the present invention is to provide a new and improved motorized jump rope apparatus which is susceptible of a low cost of manufacture with regard to both materials and labor, and which accordingly is then susceptible of low prices of sale to the consuming public, thereby making such motorized jump rope apparatus available to the buying public.

Still yet a further object of the present invention is to provide a new and improved motorized jump rope apparatus which avoids the need for a user to hold a rope in one's hands.

Still another object of the present invention is to provide a new and improved motorized jump rope apparatus that does not require a user to coordinate jumping with hand turning the rope.

Yet another object of the present invention is to provide a new and improved motorized jump rope apparatus which does not employ a water source for power and does not require the use of a water hose.

Even another object of the present invention is to provide a new and improved motorized jump rope apparatus that is not wasteful of water and does not create a wet or muddy ground surface.

Still a further object of the present invention is to provide a new and improved motorized jump rope apparatus which does not employ a U-shaped frame which limits the size of the rope that can be used.

Yet another object of the present invention is to provide a new and improved motorized jump rope apparatus that does not include a horizontal bar that extends mid-way across the region encompassed by the turning of the mechanized jump rope.

Still another object of the present invention is to provide a new and improved motorized jump rope apparatus which does not require the presence of stationary structures such as fence posts or sides of buildings for supporting the jump rope.

Yet another object of the present invention is to provide a new and improved motorized jump rope apparatus that is especially adapted to penetrate and be supported by a sandy surface.

Still a further object of the present invention is to provide a new and improved motorized jump rope apparatus that is adapted to be used with a second jumping person.

Yet another object of the present invention is to provide a new and improved motorized jump rope apparatus which has one end of the jump rope displaced from the longitudinal rotational axis.

Still a further object of the present invention is to provide a new and improved motorized jump rope apparatus that is powered by portable batteries.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

With reference to the drawings, a new and improved motorized jump rope apparatus embodying the principles and concepts of the present invention will be described.

Figure 2:
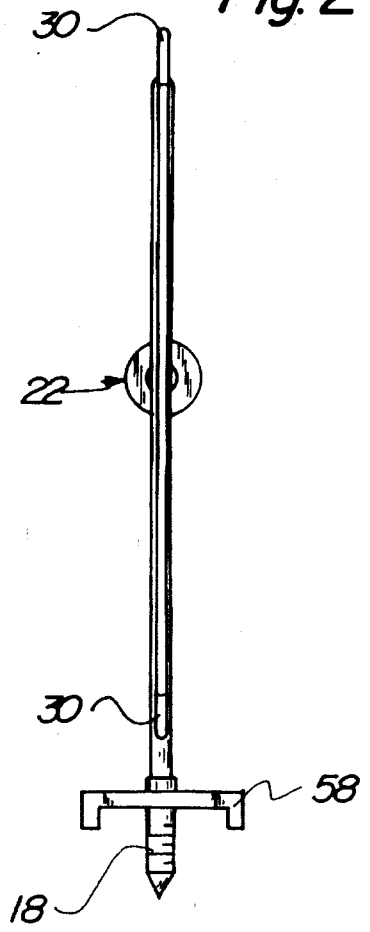
FIG. 2 is a front view of the embodiment of the motorized jump rope apparatus shown in FIG. 1 taken along line 2—2 of FIG. 1.
Figure 1:
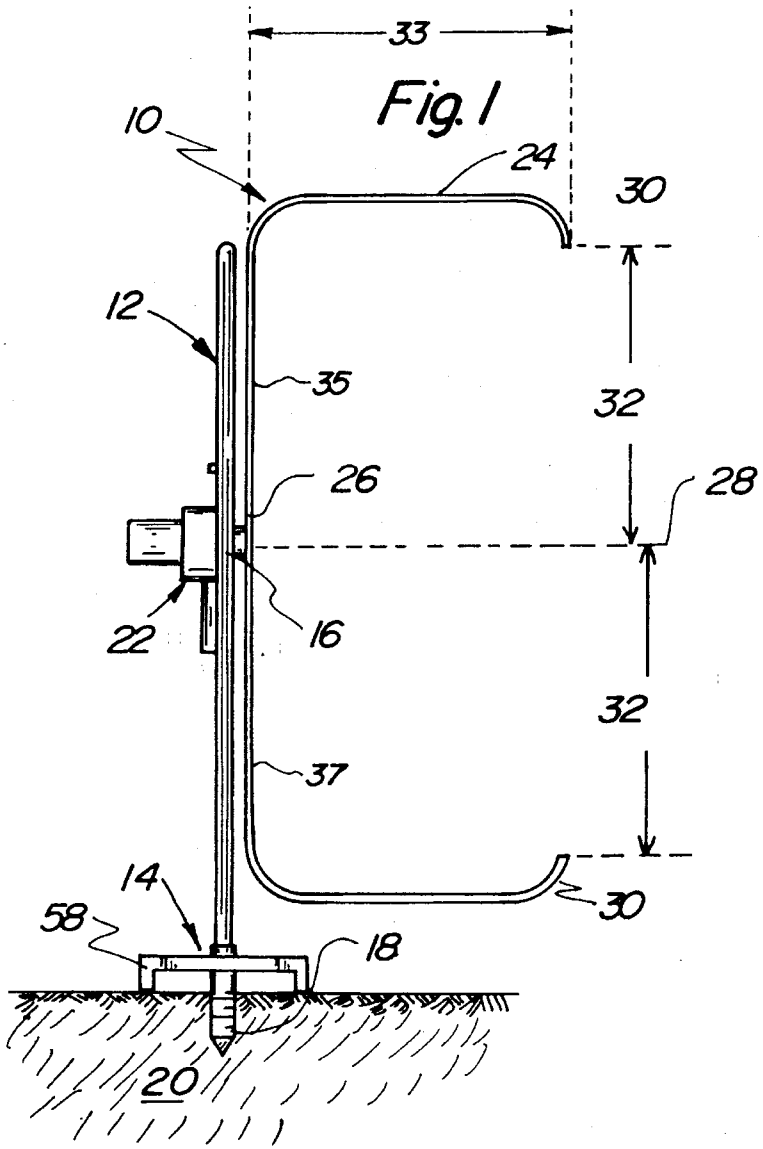
FIG. 1 is a side view showing a first preferred embodiment of the motorized jump rope apparatus of the invention which employs a vertical support screwed into the ground and which includes a rope having free ends displaced from the longitudinal rotational axis.

Turning to FIGS. 1–2, there is shown a first exemplary embodiment of the motorized jump rope apparatus of the invention generally designated by reference numeral 10. In this form, motorized jump rope apparatus 10 includes a first support assembly 12 which includes a first end portion 14 and a motor-retention portion 16. The first end portion 14 is adapted to be supported by a ground surface 20. A battery-powered motor assembly 22 is connected to the motor-retention portion 16 of the first support assembly 12, and a first jump rope assembly 24 is connected to the battery-powered motor assembly 22 at a rotational axis 28 of the battery-powered motor assembly 22. The first end portion 14 of the first support assembly 12 includes a threaded portion 18 adapted to screw into a ground surface 20.

A lateral support assembly 58 is connected to the first end portion 14 of the first support assembly 12 proximal to the threaded portion 18 for providing lateral support to the first support assembly 12 when the threaded portion 18 is screwed into a ground surface 20.

The first jump rope assembly 24 includes a first mid-portion 26 connected to the battery-powered motor assembly 22 at the rotational axis 28 of the battery-powered motor assembly 22. Two free end portions 30 of the first jump rope assembly 24 are displaced a predetermined vertical distance 32 from the rotational axis 28 and a predetermined horizontal distance 33 from the first support assembly 12 by virtue of a first portion 35 and a second portion 37 of the first jump rope assembly 24. The first portion 35 and the second portion 37 comprise a single structure whose mid-point portion is first mid-portion 26. The first portion 35 extends away from the rotational axis 28 in a first direction, and the second portion 37 extends away from the rotational axis 28 in a second direction which is opposite to the first direction. In this respect, the first jump rope assembly 24 is C-shaped.

Figure 3:
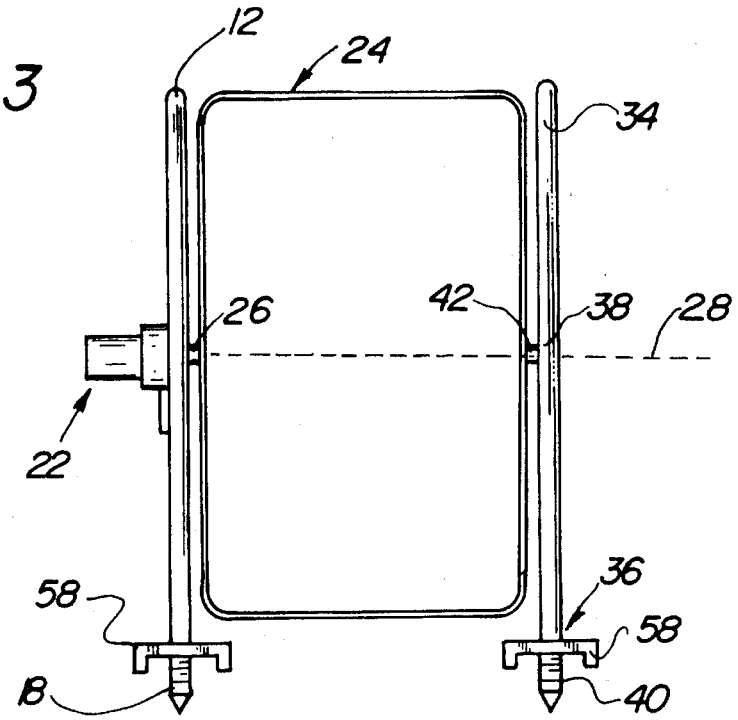
FIG. 3 is a side view of a second embodiment of the motorized jump rope apparatus of the invention wherein two vertical supports are employed and wherein the rope is in closed rectangular form.
Figure 4:
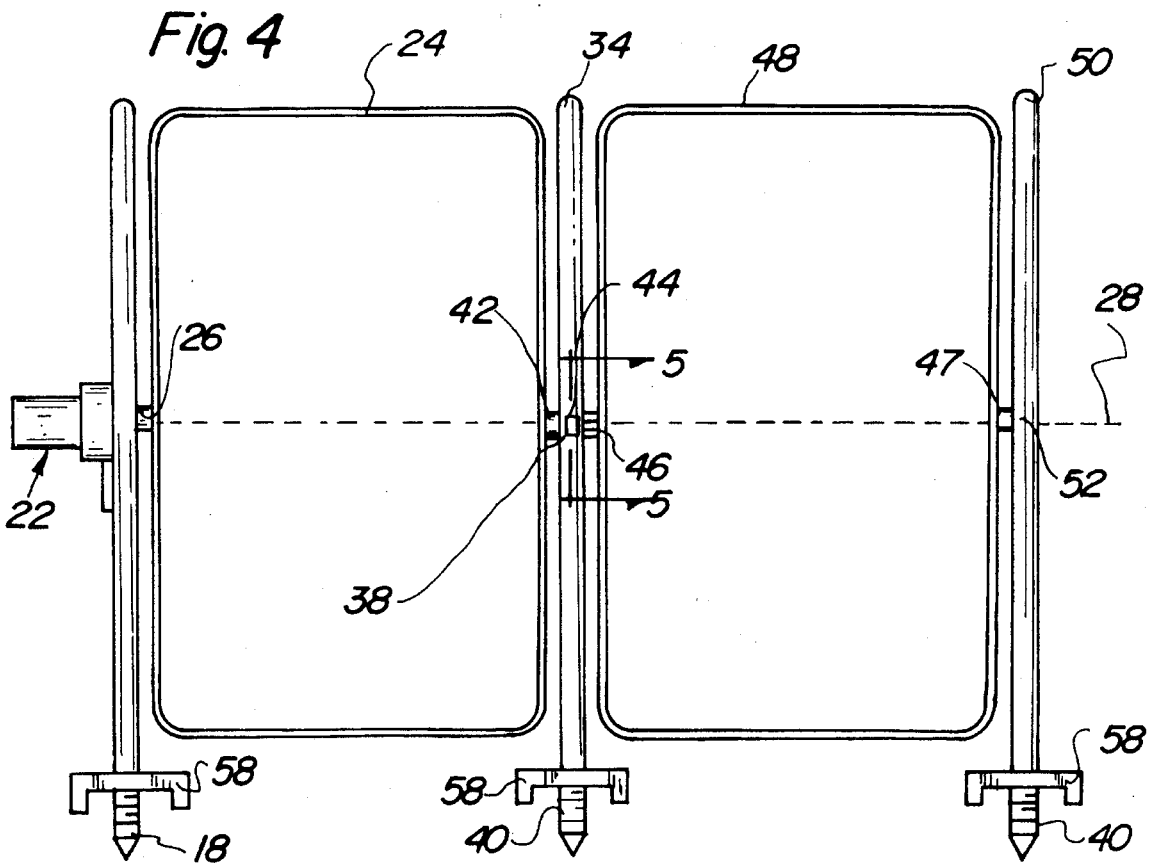
FIG. 4 is a partial side view of a third embodiment of the invention wherein a second rope can be driven by a first rope.
Figure 7:
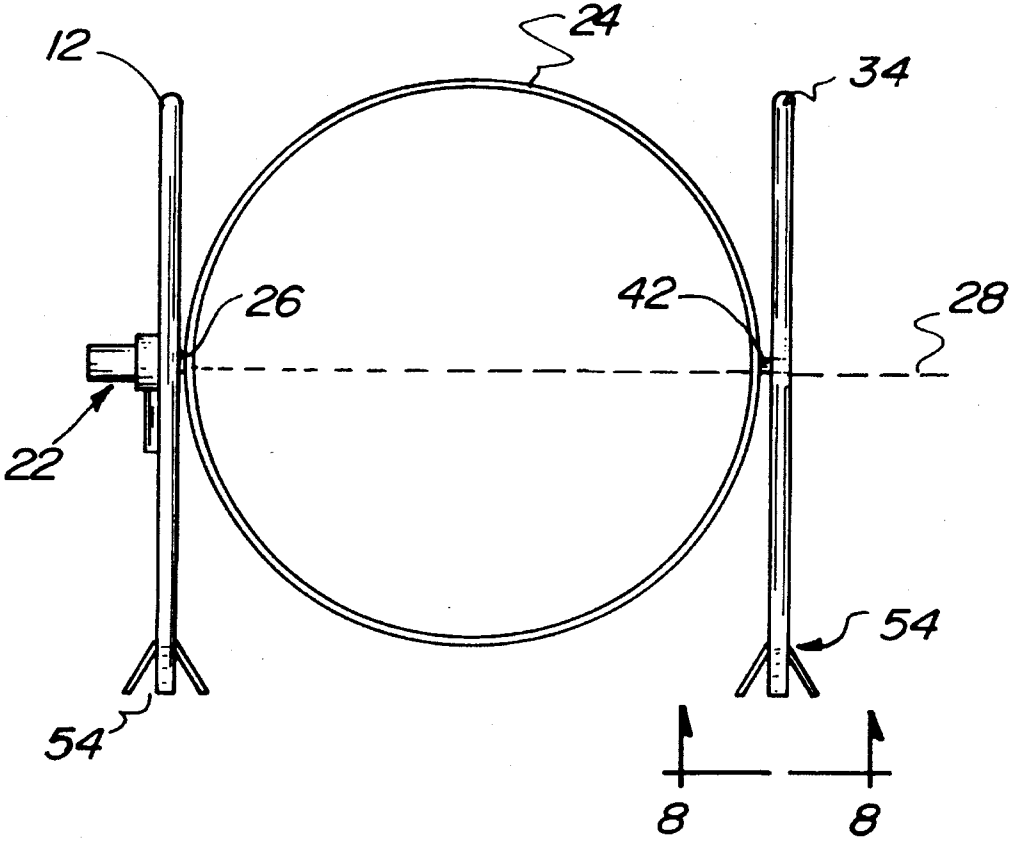
FIG. 7 is a side view of a fifth embodiment of the motorized jump rope apparatus of the invention which includes vertical supports having a set of four feet for each vertical support.

In the second embodiment of the invention shown in FIG. 3, in the third embodiment of the invention shown in FIG. 4, and in the fifth embodiment of the invention shown in FIG. 7, the first jump rope assembly 24 includes a second mid-portion 42 located along the rotational axis 28. The first jump rope assembly 24 is rectangle shaped in FIGS. 3 and 4. The first jump rope assembly 24 is circle shaped in FIG. 7.

A second support assembly 34 includes a first end portion 36 and a jump-rope-receiving portion 38 which is adapted to receive the second mid-portion 42 of the first jump rope assembly 24. The first end portion 36 of the second support assembly 34 includes a threaded portion 40 adapted to screw into a ground surface 20.

Figure 5:
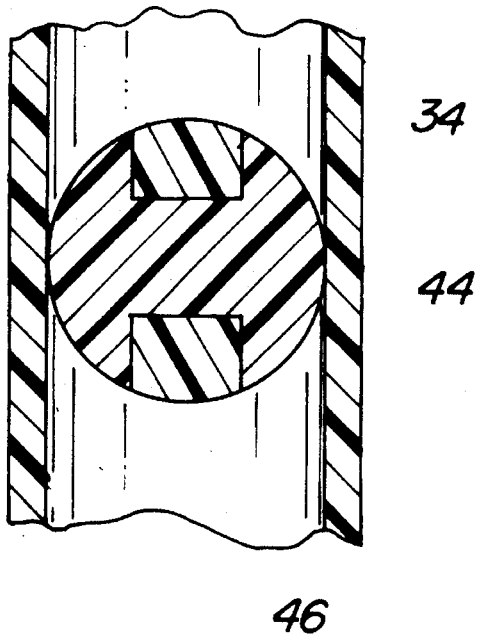
FIG. 5 is an enlarged, cross-sectional view of a portion of the embodiment of the invention shown in FIG. 4, taken along line 5—5 in FIG. 4, showing an interconnection between two jump ropes.

As shown in FIGS. 4 and 5, the second support assembly 34 further includes an output drive assembly 44 which is connected to the jump-rope-receiving portion 38. A second jump rope assembly 48 includes a first mid-portion 46 and a second mid-portion 47 located along the rotational axis 28. The first mid-portion 46 of the second jump rope assembly 48 is adapted to connect to the output drive assembly 44 of the second support assembly 34. A third support assembly 50 includes a mid-portion 52 located along the rotational axis 28. The mid-portion 52 of the third support assembly 50 is adapted to connect to the second mid-portion 47 of the second jump rope assembly 48, such that both the first jump rope assembly 24 and the second jump rope assembly 48 are driven by the battery-powered motor assembly 22. The combination of the first support assembly 12, the battery-powered motor assembly 22, the first jump rope assembly 24, the second support assembly 34, the output drive assembly 44, the second jump rope assembly 48, and the third support assembly 50 permits two jumpers to jump rope simultaneously such as in Double Dutch.

Figure 8:
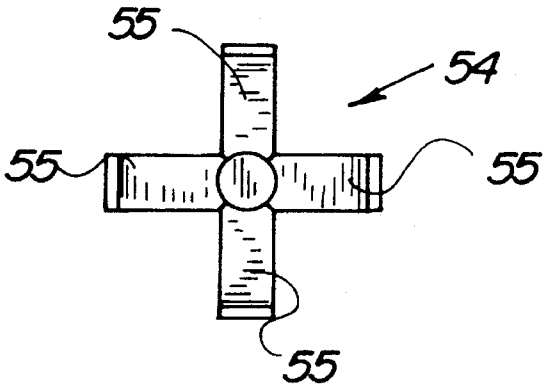
FIG. 8 is an enlarged view of a set of four feet in the embodiment of the invention shown in FIG. 7 taken along line 8—8 of FIG. 7.

As shown in FIGS. 7 and 8, the first end portion 14 of the first support assembly 12 includes a four-footed assembly 54 adapted to be supported by a surface 20. The four-footed assembly 54 includes four feet 55 positioned with respect to each other at right angles.

Figure 6:
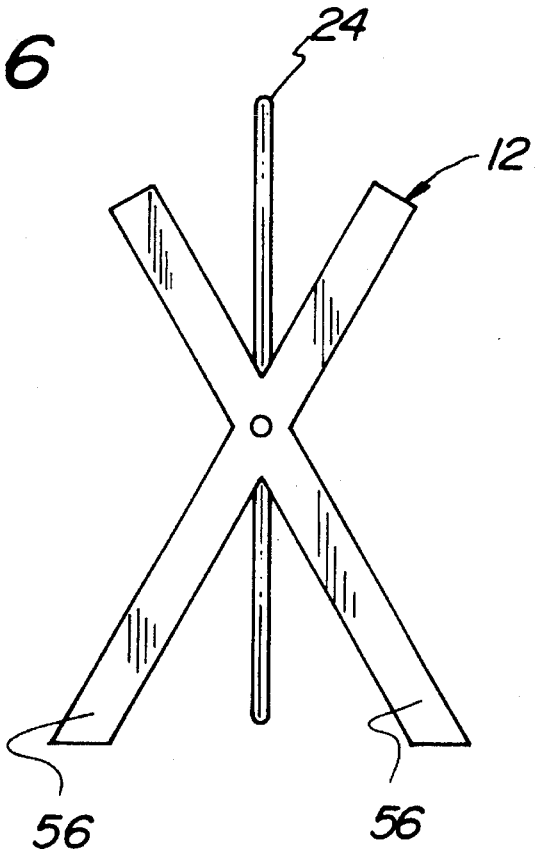
FIG. 6 a partial front view of a fourth embodiment of the invention which includes X-shaped supports for the jump rope.

In the fourth embodiment of the invention shown in FIG. 6, the first support assembly 12 is X-shaped and includes two feet 56 adapted to be supported by a ground surface 20.

In use, the motorized jump rope apparatus of the invention is installed on the ground surface 20, and the battery-powered motor assembly 22 is turned on. The jumper then jumps into the motorized jump rope.

The components of the motorized jump rope apparatus of the invention can be made from inexpensive and durable metal and plastic materials. The battery-powered motor assembly can be like the battery-powered motor assemblies that are conventionally used with battery-powered hand-held drills. The batteries can be rechargeable. The battery-powered motor assembly can be equipped with a subassembly that automatically turns off the motor when the jump rope hits a person's leg. The on/off switch for the battery-powered motor assembly can be readily accessed by the jumping person.

The jump rope itself can be made from non-flaccid material that retains its shape (e.g. C-shaped, rectangle, or circle) even when the jump rope is not being turned by the battery-powered motor assembly. The jump rope can be made from plastic coated rope. The jump rope can be covered with foam if desired.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved motorized jump rope apparatus that is low in cost, relatively simple in design and operation, and which may advantageously be used while avoiding the need for a user to hold a rope in one's hands. With the invention, a motorized jump rope apparatus is provided which does not require a user to coordinate jumping with hand turning the rope. With the invention, a motorized jump rope apparatus is provided which does not employ a water source for power and does not require the use of a water hose. With the invention, a motorized jump rope apparatus is provided which is not wasteful of water and does not create a wet or muddy ground surface. With the invention, a motorized jump rope apparatus is provided which does not employ a U-shaped frame which limits the size of the rope that can be used. With the invention, a motorized jump rope apparatus is provided which does not include a horizontal bar that extends mid-way across the region encompassed by the turning of the mechanized jump rope. With the invention, a motorized jump rope apparatus is provided which does not require the presence of stationary structures such as fence posts or sides of buildings for supporting the jump rope. With the invention, a motorized jump rope apparatus is provided which is especially adapted to penetrate and be supported by a sandy surface. With the invention, a motorized jump rope apparatus is provided which is adapted to be used with a second jumping person. With the invention, a motorized jump rope apparatus is provided which has one end of the jump rope displaced from the longitudinal rotational axis. With the invention, a motorized jump rope apparatus is provided which is powered by portable batteries.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A new and improved motorized jump rope apparatus, comprising:

a first support assembly which includes a first end portion and a motor-retention portion, wherein said first end portion is adapted to be supported by a ground surface, a battery-powered motor assembly connected to said motor-retention portion of said first support assembly, and a first jump rope assembly connected to said battery-powered motor assembly at a rotational axis of said battery-powered motor assembly, on one side of said battery-powered motor assembly and on one side of said first support assembly and connected to said battery-powered motor assembly at substantially right angles to said rotational axis, said first jump rope assembly including a first portion extending away from said rotational axis in a first direction and including a second portion extending away from said rotational axis in a second direction which is opposite to said first direction.

2. The apparatus described in claim 1 wherein said first end portion of said first support assembly includes a threaded portion adapted to screw into a ground surface.

3. The apparatus described in claim 2, further including:

a lateral support assembly connected to said first end portion of said first support assembly proximal to said threaded portion for providing lateral support to said first support assembly when said threaded portion is screwed into a ground surface.

4. The apparatus described in claim 1 wherein said first portion and said second portion of said first jump rope assembly comprise a single structure including a first mid-portion, wherein said first mid-portion is connected to said battery-powered motor assembly at said rotational axis of said battery-powered motor assembly substantially at a right angle to said rotational axis, and two free end portions of said first portion and said second portion are displaced a predetermined vertical distance from said rotational axis and a predetermined horizontal distance from said first support assembly.

5. The apparatus described in claim 1 wherein said first jump rope assembly is C-shaped.

6. The apparatus described in claim 1 wherein said first jump rope assembly includes a second mid-portion located along said rotational axis.

7. The apparatus described in claim 6 wherein said first jump rope assembly is rectangle shaped.

8. The apparatus described in claim 6 wherein said first jump rope assembly is circle shaped.

9. The apparatus described in claim 1, further including a second support assembly which includes a first end portion and a jump-rope-receiving portion adapted to receive said second mid-portion of said first jump rope assembly, wherein said first end portion of said second support assembly includes a threaded portion adapted to screw into a ground surface.

10. The apparatus described in claim 9 wherein said second support assembly further includes an output drive assembly connected to said jump-rope-receiving portion.

11. The apparatus described in claim 10, further including:

a second jump rope assembly which includes a first mid-portion and a second mid-portion located along said rotational axis, wherein said first mid-portion of said second jump rope assembly is adapted to be connected to said output drive assembly of said second support assembly, and a third support assembly which includes a mid-portion located along said rotational axis, wherein said mid-portion of said third support assembly is adapted to be connected to said second mid-portion of said second jump rope assembly, such that both said first jump rope assembly and said second jump rope assembly are driven by said battery-powered motor assembly.

12. The apparatus described in claim 1 wherein said first end portion of said first support assembly includes a four-footed assembly adapted to be supported by a ground surface.

13. The apparatus described in claim 12 wherein said four-footed assembly includes four feet positioned with respect to each other at right angles.

14. The apparatus described in claim 1, wherein said first support assembly is X-shaped and includes two feet adapted to be supported by a ground surface.

* * * * *